United States Patent [19]

Michihara et al.

[11] Patent Number: 4,606,152

[45] Date of Patent: Aug. 19, 1986

[54] METHOD OF POLISHING METAL REED BLADES OF AIR JET LOOM AND APPARATUS THEREFOR

[75] Inventors: Shinji Michihara; Akiyoshi Shimizu, both of Kanazawa, Japan

[73] Assignee: Kiji Reed Manufacturing Co., Ltd., Kanazawa, Japan

[21] Appl. No.: 696,708

[22] Filed: Jan. 31, 1985

[30] Foreign Application Priority Data

Mar. 9, 1984 [JP] Japan ..... 59-43772

[51] Int. Cl.[4] ..... B24B 19/00

[52] U.S. Cl. ..... 51/241 S; 51/324

[58] Field of Search ..... 51/241 S, 241 G, 324, 51/DIG. 17

[56] References Cited

U.S. PATENT DOCUMENTS 2,227,126 12/1940 Cooke ..... 51/324

FOREIGN PATENT DOCUMENTS 2143860 3/1972 Fed. Rep. of Germany ... 51/241 G

*Primary Examiner*—Harold D. Whitehead

*Attorney, Agent, or Firm*—Lalos, Keegan & Kaye

[57] ABSTRACT

A method and apparatus for grinding a metal need of an air jet loom for reducing the air resistance in a weft guide path of profiled reed blades.

2 Claims, 5 Drawing Figures

METHOD OF POLISHING METAL REED BLADES OF AIR JET LOOM AND APPARATUS THEREFOR

BACKGROUND OF THE INVENTION

This invention relates to a method and an apparatus of making a metal reed of an air jet loom, and more particularly to an abrasive working method and an apparatus therefor for reducing the air resistance in a weft guide path of so called profiled reed blades (modified reeds).

The air guide path for guiding a weft in the air jet loom is known as an air guide separately provided adjacent to the cloth fell side of the metal reed or an air guide recess cut into the projecting portion of the reed blades themselves, but this invention relates to the latter, namely, a well known so called profiled reed blades in which a recess portion is formed in the projecting portion at the middle of the blade so that an air guide path is formed when a large number of reed blades are assembled in parallel to complete a metal reed.

In the air jet loom, in which the weft is caused to fly by the air jet into the guide path formed by the aforesaid reed blades, it is well known that many devices have been made heretofore in order to transport the weft stably at high speed as much as possible.

Namely, the guide path for transporting the weft is provided so as not to attenuate the air jet energy as feasible as possible, and also, auxiliary nozzles are provided at a fixed interval in the guide path for reaccelerating the attenuating air jet velocity, and furthermore, some devices were made on the shape of recess of the air guide portion of the blade to minimize the attenuation of the air jet velocity as feasible as possible.

This invention is characterized in that by utilizing the abrasive polishing process by means of a high speed rotary buffer as means of forming a preferred shape of the cross section of the blade of the profiled reed, not only the working method is simplified but also the air guide path of the polished blades is adjusted and trimmed as a whole to an extremely smooth configuration in which the air resistance is remarkably reduced.

An embodiment of this invention will be described in details in the following by referring to the drawings.

DETAILED DESCRIPTION OF THE INVENTION

Figure 1:
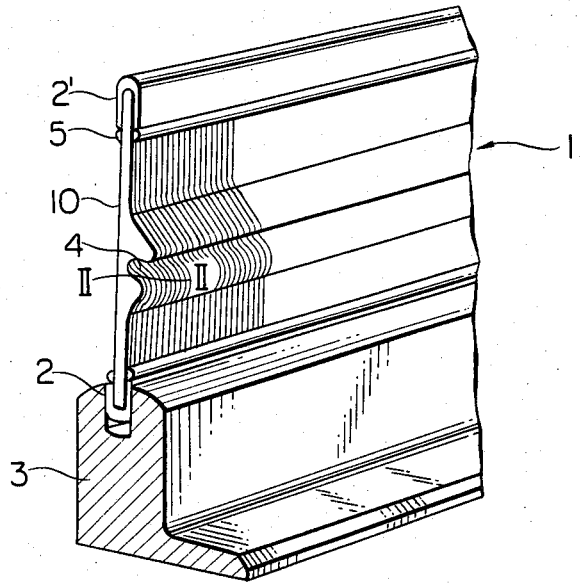
FIG. 1 is a perspective view showing a condition in which a profiled reed being applied to a polishing method according to this invention is uprightly supported on a support base.
Figure 2A:
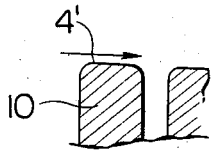
FIGS. 2A and 2B are cross sections taken along a line II—II of an air guide recess of the blade of FIG. 1, and 2A shows the configuration before the polishing process and 2B shows the configuration after the polishing process.
Figure 2B:
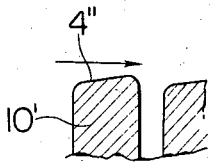

FIG. 1 shows the condition (a parent blade of side portion is omitted) in which a profiled reed (modified reed) 1 being applied to the polishing method of this invention is uprightly errected on a supporting base 3 by inserting a lower slay 2 of the profiled reed 1. The cross section along the U-shaped recess portion of the guide path of each blade 10 was originally rectangular as shown in FIG. 2A having such parallel surface 4' in the direction of the air current but recently the air guide path came to be tapered like nozzle that reduces the cross sectional area gradually in the direction V of the air current as shown in FIG. 2B, which minimizes the attenuation of the air jet velocity and is effective in saving the energy required for the air jet so that such tapered surface 4" is frequently used in the air jet metal reed of this air jet loom system. The inclined surface 4" as described in the foregoing is construed to contribute in maintaining the velocity of the air jet by preventing a tendency of leaking a part of the jet air into the gaps between the blades 10, namely, in the direction perpendicular to the air guide path and by inducing some quantity of air through the gaps between the reed blades into the air jet. Also, the inclined surface 4" is considered desirable for allowing the auxiliary nozzle (not shown in the drawing) to function effectively.

In order to form the inclined surface 4" on the blade 10 as described in the foregoing, heretofore the blade is formed individually into the cross section of the air guide path as shown in FIG. 2B and thereafter a plurality of the blades 10 are assembled in a predetermined reed blade distance by means of a coil wire 5 between an upper slay 2' and a lower slay 2. But, in this invention, the assembly of the reed blades is carried out in the condition where the cross section of each blade 10 has a rectangular shape with an adequate rounded edges of a surface 4' in parallel to the direction of the air current as shown in FIG. 2A so that the assembling process can be decreased accordingly.

Figure 4:
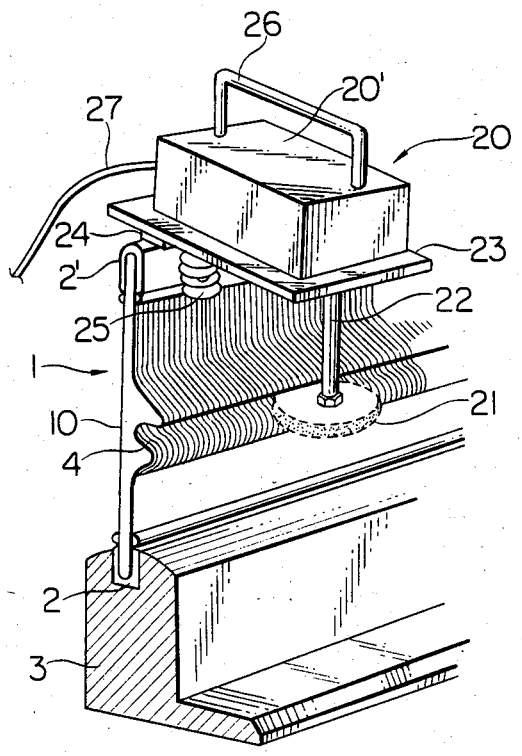
FIG. 4 is a perspective view showing the working condition of the blade polishing apparatus of this invention.

After the assembled blades 1 are rigidly supported on the support base 3 by fitting the lower slay 2 into the base 3, the polishing apparatus 20 is mounted slidably on the upper slay 2' as shown in FIG. 4, the polishing apparatus 20 will be travelled slowly along the guide path and then the guide path recess portion 4 of the blade 10 will be abrasively polished by the rotary buffer 21 so as to form the cross section 4" as shown in FIG. 2B, the details thereof will be explained hereinafter.

For the convenience of the description, the polishing apparatus 20 shown in FIG. 4 will now be explained. Although the polishing apparatus 20 is shown by only its outside view, it should be sufficient to know the fact that in its inside, a sewing machine motor of, for example, 100 V, 75 W and 6000 rpm is mounted, and its output shaft is extended downwardly and at the lower end of the shaft is fixed with a rotary polishing buffer 21. In this embodiment, as the abrasive material of the rotary buffer, a material (tradename, Kenmaron, produced by Sankyo Rikagaku Co., 3-1, 3-chome, Marunouchi Chiyoda-ku, Tokyo) a combination product of aluminum oxide powder, glass wool and adhesive resin is used. An adequate cooling fan (not shown) is included in the body 20' of the polishing apparatus 20, and on the lower side of the support plate 23 supporting the body 20', a slide plate (for example, Nylon plate) 24 is fixed and slidable on the upper slay 2' of the metal reed, and, four sets of rollers 25 (in the drawing, only one set is shown) are disposed on both sides of the slide plate 24 in riding manner on the upper slay 2' in order to precisely hold rotary buffer in a predetermined relative position against the air guide recess surface 4 in contact mode. Reference numeral 26 denotes a handle, and numeral 27 denotes a power source cord.

Figure 3:
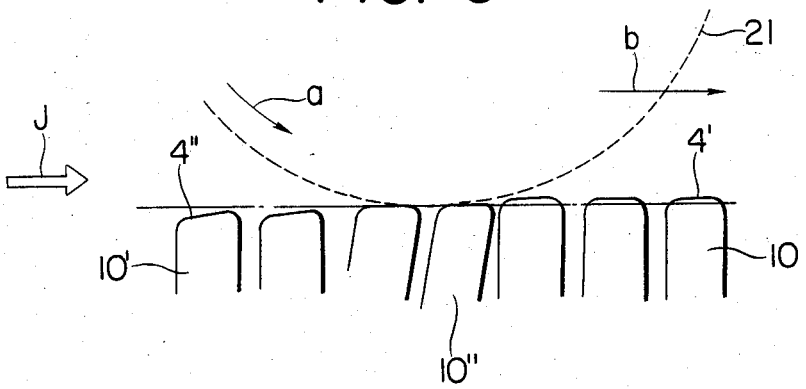
FIG. 3 is an explanatory view of the abrasive polishing method of the air guide portion of the blades of this invention.

The description will be made in the following to explain how the guide path 4 of the blade 10 is to be abraded by the rotary buffer 21 to form the shape of the cross section having the inclinded surface 4'' as mentioned above. FIG. 3 is an enlarged view of an essential portion for the description of the condition of the blade in the abrasive polishing process, and a large number of blades 10 already assembled are arranged with their rectangular surfaces 4'. Now, the particular mode of operation according to this invention will be started as the following manner. The rotary buffer 21 is moved in the direction of the arrow b while rotating at high speed in the direction of the arrow a, the blade 10 will be laterally bent and simultaneously abraded and polished with the position forceably bent as shown at 10'' when it enters the contact range with the rotary buffer 21 has passed a blade, it so that when the rotary buffer 21 returns to the normal vertical position 10' as shown in FIG. 3 by its resilliency after passing of the rotary buffer. As the result, the cross section of the blade is formed with the inclined surface 4''.

According to several experiments conducted by the applicant, in case the thickness of the blade was 0.7 mm, this inclined angle was about 10°, and in case the thickness of the blade was 0.4 mm, the inclined angle became about 20°. Of course, a relationship between the thickness of the blade and the abraded inclined angle by the polishing buff should be variable according to the qualities of the rotary buffer used (external dimension, resiliency, abrasive material, rpm and the like) so that the quality of the rotary buffer will be required to be properly adjusted according to the inclined surface desired, but this invention will not be intended to contain the precise data in respective cases and they can be left to the selection of those skilled in the art who will use this invention. It should be understood that we found the fact that by the method according to this invention of forming the foregoing inclined surface 4'' on the blade with the use of the rotary buffer, the following features can be obtained which are more advantageous than the conventional processing of the reed blades which was done before the assembly of the blades.

1. Number of man-hours for the whole assembly decreases.

2. As the buffing polishing is carried out in the direction of the air jet, minute acute portions on the air guide path which otherwise become the air resistance are eliminated.

3. It can be utilized for the adjusting polishing of the reed in a existing loom.

4. The use and the handling of the rotary buffer are easy.

By the way, a test example of blade polishing effect by this invention is shown in the following table in which the jet air velocity was measured at a point 90 mm downstream from the location of an auxiliary nozzle.

thickness of blade . . . 0.2 mm
thickness of polishing buffer . . . slightly larger than the width of the air guide recess of the blade
diameter of polishing buffer . . . 75 mm
rpm of polishing buffer . . . 6,000/min.

Effect Tests of Polishing Reed Blades

| item | No. 1 | No. 2 | No. 3 | No. 4 | notes |
|---|---|---|---|---|---|
| Rotating direction of the polishing buffer | a | a | reverse a | reverse a | With reverse a, inclined surface becomes reverse-side |
| Travelling direction of the polishing buffer | b | reverse b | b | reverse b | As diameter of buffer is extremely larger than thickness of reed blade, travelling direction has no influence on polishing effect |
| Rotation of polishing buffer (rpm) | 6000 | 6000 | 6000 | 6000 | Ordinary high speed rotation is acceptable |
| Jet air velocity before polishing (m/sec) | 76 | 76 | 76 | 76 | Measurement by pitot tube |
| Jet air velocity after polishing (m/sec) | 85 | 85 | 70 | 68 | Corresponds to comparison of air jet J of FIG. 3 with reverse J |

Remarks:
The foregoing data are averages of test results of about 10 times.

As described in the foregoing, an abrasive polishing formation of the inclined surface of the air guide path in the reed blades of the air jet loom was described illustratively, but it should be understood by those who are skilled in the art that many modifications within the gists of the claims are feasible.

What is claimed is:

1. A method of abrasively polishing the inner surface of an air guide recess in the middle portion of metal reed blades opened in the direction of the fell of the cloth of an air jet loom, comprising slidably mounting a rotary buffer 21 having a dimension being in contact with the inner surface 4' of said air guide recess portion 4 of said metal reed blades, rotating said rotary buffer in the direction to resiliently bend and abrasively contact with said inner surfaces 4' of said reed blades, and shifting said rotating buffer along said air guide recess in the direction of the air jet to be ejected, whereby the inner surface 4' of respective blades parallel to the direction of the air jet will be abraded and polished to form an inclined surface 4'' of a profiled blade to the direction of the air jet to be ejected so as to form a tapered nozzle configuration of the air guide recess of respective blade and finish an inner surface of said air guide path uniformly.

2. Apparatus for abrasively polishing an air guide recess in the middle portion of metal reed blades opened in the direction of the fell of the cloth of an air jet loom, comprising a support base 3 for rigidly supporting the lower slay 2 of said metal reeds to be polished, a polishing device 20 slidably mounted on the upper slay 2' of said metal reeds to be polished, said polishing device 20 including a driving motor box 20', a rotary buffer 21 driven by a driven shaft 22 extending downward from said motor box 20', a slide plate 24 with side rollers 25 for precisely shifting said polishing device 20 along the upper slay 2' of said metal reeds, and the direction of rotation of said polishing buffer 21 is in the direction of forcedly bending the blades 10 in the direction of the air jet while contacting the inner surface of said blades, whereby after said rotating buffer 21 passed by said bended blades, a tapered nozzle configuration of said air guide recess will be provided.

* * * * *